US010343022B2

(12) United States Patent
Takihara et al.

(10) Patent No.: US 10,343,022 B2
(45) Date of Patent: Jul. 9, 2019

(54) GOLF BALL

(71) Applicant: DUNLOP SPORTS CO. LTD., Kobe-shi, Hyogo (JP)

(72) Inventors: Hironori Takihara, Kobe (JP); Takahiro Sajima, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/728,982

(22) Filed: Oct. 10, 2017

(65) Prior Publication Data

US 2018/0161634 A1 Jun. 14, 2018

(30) Foreign Application Priority Data

Dec. 12, 2016 (JP) ..... 2016-240016

(51) Int. Cl.
*A63B 37/06* (2006.01)
*A63B 37/00* (2006.01)

(52) U.S. Cl.
CPC ..... *A63B 37/0092* (2013.01); *A63B 37/00* (2013.01); *A63B 37/0031* (2013.01); *A63B 37/0033* (2013.01); *A63B 37/0039* (2013.01); *A63B 37/0043* (2013.01); *A63B 37/0045* (2013.01); *A63B 37/0062* (2013.01); *A63B 37/0064* (2013.01); *A63B 37/0067* (2013.01); *A63B 37/0075* (2013.01); *A63B 37/0076* (2013.01); *A63B 37/0096* (2013.01)

(58) Field of Classification Search
CPC ..... A63B 37/0092
USPC ..... 473/373, 374
See application file for complete search history.

(56) References Cited

U.S. PATENT DOCUMENTS

2003/0040378 A1 2/2003 Endo et al.
2011/0319193 A1 12/2011 Isogawa et al.
2013/0005505 A1* 1/2013 Sajima ..... C08K 5/09 473/372
2013/0296072 A1 11/2013 Nakajima et al.

* cited by examiner

*Primary Examiner* — Raeann Gorden
(74) *Attorney, Agent, or Firm* — Birch, Stewart, Kolasch & Birch, LLP

(57) ABSTRACT

A golf ball 2 includes a core 4, a mid layer 6 positioned outside this core, and a cover 8 positioned outside this mid layer. When a total thickness of the mid layer 6 and the cover 8 is denoted by L (mm), a Shore C hardness at a point A away from a surface of the core 4 toward a central point of the core 4 by 5L (mm) is denoted by Ha, a Shore C hardness at a point B away from the surface of the core 4 toward the central point of the core 4 by 2.5L (mm) is denoted by Hb, and a Shore C hardness at the central point of the core 4 and Shore C hardnesses of the mid layer 6 and the cover 8 are denoted by H0, Hm, and Hc, respectively; the golf ball 2 satisfies Hc−Hb>0, Hm−H0>0, and Ha−Hm>0.

17 Claims, 1 Drawing Sheet

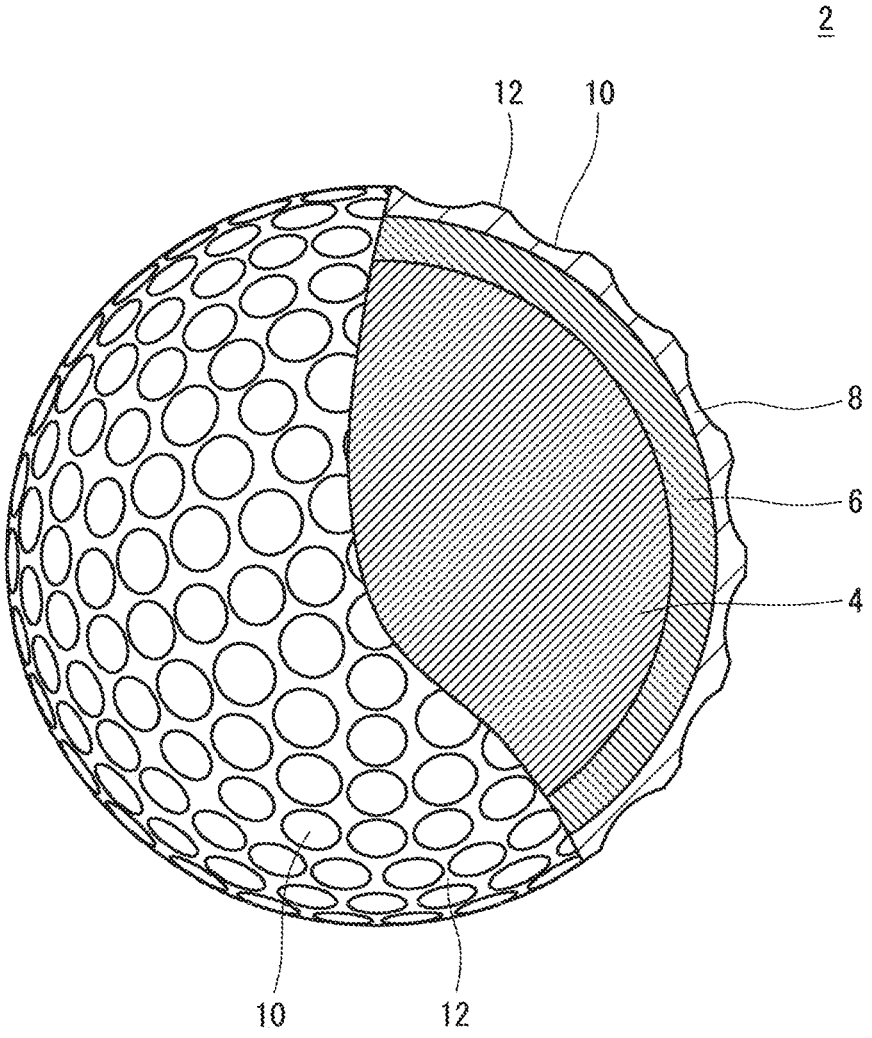
2
12
10
8
6
4
10
12

GOLF BALL

This application claims priority on Patent Application No. 2016-240016 filed in JAPAN on Dec. 12, 2016. The entire contents of this Japanese Patent Application are hereby incorporated by reference.

BACKGROUND OF THE INVENTION

Field of the Invention

The present invention relates to golf balls. Specifically, the present invention relates to multi-piece golf balls.

Description of the Related Art

Golf players' foremost requirement for golf balls is flight performance. In particular, golf players place importance on flight performance upon a shot with a driver. Another interest to golf players concerning golf balls is feel at impact. Generally, golf players prefer soft feel at impact. There have been various proposals for improvement of flight performance and feel at impact.

In JP2003-52855 (US2003/0040378 A1), the following examination is made: in a three-piece ball including a center, a mid layer, and a cover, a hardness difference from the central point of the center to the surface of the center is made relatively small to specify the amount of compressive deformation of the center within a specific range. JP2012-10726 (US2011/0319193 A1) discloses a golf ball including a core in which there is no zone in which the hardness decreases from the central point of the core to the surface of the core.

In the core of the golf ball disclosed in JP2013-9916 (US2013/0005505 A1), a hardness distribution is formed in which the hardness linearly increases from the central point of the core toward the surface of the core. JP2013-230365 (US2013/0296072 A1) proposes a core having a hardness distribution in which the hardness does not greatly vary from the central point of the core to a predetermined position and increases at a steep gradient therefrom to the surface of the core.

Golf players' requirements for golf balls have been escalated. In particular, there is room for improvement of flight performance upon a shot with a driver and feel at impact upon putting. An object of the present invention is to provide a golf ball with which a large flight distance is achieved upon a shot with a driver and with which soft feel at impact is obtained upon putting.

SUMMARY OF THE INVENTION

A golf ball according to the present invention includes a core, a mid layer positioned outside the core, and a cover positioned outside the mid layer. When a total thickness of the mid layer and the cover is denoted by L (mm), a Shore C hardness at a point A away from a surface of the core toward a central point of the core by 5L (mm) is denoted by Ha, a Shore C hardness at a point B away from the surface of the core toward the central point of the core by 2.5L (mm) is denoted by Hb, a Shore C hardness at the central point of the core is denoted by H0, a Shore C hardness of the mid layer is denoted by Hm, and a Shore C hardness of the cover is denoted by Hc, the golf ball satisfies the following formulas (1) to (3):

$$Hc-Hb>0 \quad (1),$$

$$Hm-H0>0 \quad (2), \text{ and}$$

$$Ha-Hm>0 \quad (3).$$

In the golf ball according to the present invention, the hardness distribution within the core and the hardness distribution of the entire golf ball are appropriate. When the golf ball is hit with a driver, the spin rate is low. Therefore, with the golf ball, a large flight distance is achieved upon a shot with a driver. Furthermore, feel at impact upon putting of the golf ball is soft. The golf ball has excellent flight performance upon a shot with a driver and excellent feel at impact upon putting.

Preferably, the golf ball includes a mid layer formed of a plurality of layers. Preferably, a Shore C hardness of a most flexible layer among the plurality of layers forming the mid layer is regarded as the hardness Hm.

Preferably, a difference (Hc−Hb) between the hardness Hc and the hardness Hb is greater than 15 and less than 40. Preferably, a difference (Hm−H0) between the hardness Hm and the hardness H0 is not less than 1 and not greater than 20. Preferably, a difference (Ha−Hm) between the hardness Ha and the hardness Hm is not less than 1 and not greater than 15.

Preferably, a difference (Hs−H0) between a Shore C hardness Hs at the surface of the core and the hardness H0 is not less than 20 and not greater than 40.

Preferably, a difference (Hc−Hm) between the hardness Hc and the hardness Hm is greater than 25 and less than 50. Preferably, a difference (Hb−Hm) between the hardness Hb and the hardness Hm is greater than 5 and less than 25. Preferably, a difference (Hb−Ha) between the hardness Hb and the hardness Ha is greater than 7 and less than 15. Preferably, a difference (Ha−H0) between the hardness Ha and the hardness H0 is greater than 5 and less than 18. Preferably, a difference (Hb−H0) between the hardness Hb and the hardness H0 is greater than 12 and less than 30.

Preferably, the hardness Hm is greater than 40 and less than 67. Preferably, the total thickness L is not greater than 3.2 mm.

Preferably, the hardness Hc is greater than a Shore C hardness of a hardest layer among a plurality of layers forming the mid layer.

BRIEF DESCRIPTION OF THE DRAWINGS

FIG. 1 is a partially cutaway cross-sectional view of a golf ball according to an embodiment of the present invention.

DESCRIPTION OF THE PREFERRED EMBODIMENTS

The following will describe in detail the present invention based on preferred embodiments with appropriate reference to the drawings.

A golf ball 2 shown in FIG. 1 includes a spherical core 4, a mid layer 6 positioned outside the core 4, and a cover 8 positioned outside the mid layer 6. The golf ball 2 has a plurality of dimples 10 on the surface thereof. Of the surface of the golf ball 2, a part other than the dimples 10 is a land 12. The golf ball 2 includes a paint layer and a mark layer on the external side of the cover 8 although these layers are not shown in the drawing. The golf ball 2 may include another layer between the core 4 and the mid layer 6. The golf ball 2 may include another layer between the mid layer 6 and the cover 8.

The golf ball 2 preferably has a diameter of not less than 40 mm and not greater than 45 mm. From the standpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The golf ball 2 preferably has a weight of not less than 40 g and not greater than 50 g. In light of attainment of great inertia, the weight is more preferably not less than 44 g and particularly preferably not less than 45.00 g. From the standpoint of conformity to the rules established by the USGA, the weight is particularly preferably not greater than 45.93 g.

When the total thickness of the mid layer 6 and the cover 8 is denoted by L (mm), a Shore C hardness Ha at a point A away from the surface of the core 4 toward the central point of the core 4 by 5L (mm), a Shore C hardness Hb at a point B away from the surface of the core 4 toward the central point of the core 4 by 2.5L (mm), a Shore C hardness H0 at the central point of the core 4, and a Shore C hardness Hs at the surface of the core 4 are measured in the present invention. A Shore C type hardness scale mounted to an automated hardness meter (trade name "digi test II" manufactured by Heinrich Bareiss Prüfgerätebau GmbH) is used for measuring each hardness. The hardness Ha, the hardness Hb, and the hardness H0 are measured by the hardness scale being pressed against the cross-section of a hemisphere obtained by cutting the golf ball 2. The hardness Hs is measured by the hardness scale being pressed against the surface of the core 4. All the measurements are conducted in an environment of 23° C.

As shown, the mid layer 6 of the golf ball 2 according to this embodiment is composed of a single layer. In the golf ball 2, a slab hardness of the mid layer 6, which is composed of a single layer, is measured as a hardness Hm. In a golf ball according to another embodiment of the present invention, the mid layer 6 is formed of a plurality of layers. In the golf ball including the mid layer 6 composed of the plurality of layers, each of slab hardnesses of the plurality of layers forming the mid layer 6 is measured, and the slab hardness of the most flexible layer among the plurality of layers is regarded as a hardness Hm.

The slab hardness of the mid layer 6 and the slab hardness of each layer forming the mid layer 6 are measured with a Shore C type hardness scale mounted to an automated hardness meter (trade name "digi test II" manufactured by Heinrich Bareiss Prüfgerätebau GmbH) according to the standards of "ASTM-D 2240-68". For the measurement, a sheet that is formed by hot press, that is formed from the same material as that of the mid layer 6, and that has a thickness of about 2 mm is used. Prior to the measurement, a sheet is kept at 23° C. for two weeks. At the measurement, three sheets are stacked.

The cover 8 of the golf ball 2 is composed of a single layer. In the golf ball 2, a slab hardness of the cover 8 is measured as a hardness Hc. The slab hardness of the cover 8 is measured by the same method as that for the slab hardness of the mid layer 6.

In the golf ball according to the present invention, the hardness Hc is greater than the hardness Hb, the hardness Hm is greater than the hardness H0, and the hardness Ha is greater than the hardness Hm. That is, in the golf ball 2, the hardness Ha, the hardness Hb, the hardness H0, the hardness Hm, and the hardness Hc satisfy the following formulas (1) to (3).

$$Hc-Hb>0 \quad (1)$$

$$Hm-H0>0 \quad (2)$$

$$Ha-Hm>0 \quad (3)$$

By satisfying the above formulas (1) to (3), in the golf ball 2, the spin upon a shot with a driver is suppressed and a large flight distance is obtained, and feel at impact upon putting is also significantly improved.

In light of spin suppression upon a shot with a driver, the difference (Hc−Hb) between the hardness Hc and the hardness Hb is preferably greater than 15, more preferably not less than 16, and particularly preferably not less than 17. In light of feel at impact upon putting, the difference (Hc−Hb) is preferably less than 40 and more preferably not greater than 38.

The difference (Hm−H0) between the hardness Hm and the hardness H0 contributes to spin suppression upon a shot with a driver. In this respect, the difference (Hm−H0) is preferably not less than 1 and more preferably not less than 2. In light of feel at impact upon putting, the difference (Hm−H0) is preferably not greater than 20 and more preferably not greater than 18.

The difference (Ha−Hm) between the hardness Ha and the hardness Hm contributes to feel at impact upon putting. In this respect, the difference (Ha−Hm) is preferably not less than 1 and more preferably not less than 2. In light of spin suppression upon a shot with a driver, the difference (Ha−Hm) is preferably not greater than 15 and more preferably not greater than 14.

In light of improvement of flight performance, the difference (Hs−H0) between the hardness Hs and the hardness H0 is preferably not less than 20 and more preferably not less than 22. In light of durability, the difference (Hs−H0) is preferably not greater than 40 and more preferably not greater than 38.

In light of spin suppression upon a shot with a driver, the difference (Hc−Hm) between the hardness Hc and the hardness Hm is preferably greater than 25 and more preferably greater than 27. In light of durability, the difference (Hc−Hm) is preferably less than 50.

In light of feel at impact upon putting, the difference (Hb−Hm) between the hardness Hb and the hardness Hm is preferably greater than 5 and more preferably not less than 7. In light of resilience upon a shot with a driver, the difference (Hb−Hm) is preferably less than 25.

In light of spin suppression upon a shot with a driver, the difference (Hb−Ha) between the hardness Hb and the hardness Ha is preferably greater than 7 and more preferably not less than 8. In light of durability, the difference (Hb−Ha) is preferably less than 15.

In light of spin suppression upon a shot with a driver, the difference (Ha−H0) between the hardness Ha and the hardness H0 is preferably greater than 5 and more preferably not less than 6. In light of durability, the difference (Ha−H0) is preferably less than 18.

In light of spin suppression upon a shot with a driver, the difference (Hb−H0) between the hardness Hb and the hardness H0 is preferably greater than 12 and more preferably not less than 13. In light of durability, the difference (Hb−H0) is preferably less than 30.

The core 4 is formed by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferable. When a polybutadiene and another rubber are used in combination, it is preferred if the polybutadiene is a principal component. Specifically, the proportion of the polybutadiene to the entire base rubber is preferably not less than 50% by weight and particularly preferably not less than 80% by weight. A polybutadiene in which the proportion of cis-1,4 bonds is not less than 80% is particularly preferable.

The rubber composition of the core 4 preferably includes a co-crosslinking agent. Preferable co-crosslinking agents in light of resilience performance are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance, zinc acrylate and zinc methacrylate are particularly preferable.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

In light of resilience performance of the golf ball 2, the amount of the co-crosslinking agent per 100 parts by weight of the base rubber is preferably not less than 10 parts by weight and more preferably not less than 15 parts by weight. In light of feel at impact, the amount is preferably not greater than 50 parts by weight and more preferably not greater than 45 parts by weight.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

In light of resilience performance of the golf ball 2, the amount of the organic peroxide per 100 parts by weight of the base rubber is preferably not less than 0.1 parts by weight, more preferably not less than 0.3 parts by weight, and particularly preferably not less than 0.5 parts by weight. In light of feel at impact, the amount is preferably not greater than 3.0 parts by weight, more preferably not greater than 2.8 parts by weight, and particularly preferably not greater than 2.5 parts by weight.

Preferably, the rubber composition of the core 4 includes an organic sulfur compound. Organic sulfur compounds include naphthalenethiol compounds, benzenethiol compounds, and disulfide compounds. Two or more organic sulfur compounds may be used in combination. A naphthalenethiol compound and a disulfide compound are preferably used in combination.

Examples of naphthalenethiol compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance of the golf ball 2, the amount of the organic sulfur compound per 100 parts by weight of the base rubber is preferably not less than 0.1 parts by weight and particularly preferably not less than 0.2 parts by weight. In light of feel at impact, the amount is preferably not greater than 1.5 parts by weight, more preferably not greater than 1.0 parts by weight, and particularly preferably not greater than 0.8 parts by weight. When two or more organic sulfur compounds are used in combination, the total amount of these organic sulfur compounds is regarded as the amount of the organic sulfur compound.

Preferably, the rubber composition of the core 4 includes a carboxylic acid or a carboxylate in addition to the aforementioned co-crosslinking agent. The core 4 including a carboxylic acid or a carboxylate has a low hardness around the central point thereof. The core 4 has an outer-hard/inner-soft structure. When the golf ball 2 including the core 4 is hit with a driver, the spin rate is low. With the golf ball 2 having a low spin rate, a large flight distance is obtained. Examples of preferable carboxylic acids include aromatic carboxylic acids such as benzoic acid, phthalic acid, and salicylic acid. Examples of preferable carboxylates include fatty acid metal salts such as zinc octoate, zinc laurate, zinc myristate, and zinc stearate. The rubber composition particularly preferably includes benzoic acid. The amount of the carboxylic acid and/or the carboxylate per 100 parts by weight of the base rubber is preferably not less than 0.5 parts by weight and not greater than 20 parts by weight.

The rubber composition of the core 4 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the core 4 is accomplished. The rubber composition may include various additives, such as sulfur, an anti-aging agent, a coloring agent, a plasticizer, a dispersant, and the like, in an adequate amount. The rubber composition may include crosslinked rubber powder or synthetic resin powder.

The temperature for crosslinking the core 4 is not lower than 140° C. and not higher than 180° C. The time period for crosslinking the core 4 is not shorter than 10 minutes and not longer than 60 minutes. The core 4 may have two or more layers.

The core 4 preferably has a diameter of not less than 36.0 mm. The core 4 having a diameter of not less than 36.0 mm contributes to the resilience performance of the golf ball 2. In this respect, the diameter is more preferably not less than 36.5 mm and particularly preferably not less than 37.0 mm. From the standpoint that the mid layer 6 and the cover 8 can have sufficient thicknesses, the diameter is preferably not greater than 41.0 mm and particularly preferably not greater than 40.5 mm. The core 4 preferably has a weight of not less than 10 g and not greater than 40 g.

In light of resilience performance, the Shore C hardness H0 at the central point of the core 4 is preferably not less than 40, more preferably not less than 42, and particularly preferably not less than 44. In light of spin suppression and feel at impact, the hardness H0 is preferably not greater than 60, more preferably not greater than 58, and particularly preferably not greater than 56.

In light of resilience performance, the Shore C hardness Ha at the point A away from the surface of the core 4 toward the central point of the core 4 by 5L (mm) is preferably not less than 45 and more preferably not less than 47. In light of spin suppression and feel at impact, the hardness Ha is preferably not greater than 78 and more preferably not greater than 76.

In light of resilience performance, the Shore C hardness Hb at the point B away from the surface of the core 4 toward the central point of the core 4 by 2.5L (mm) is preferably not less than 55 and more preferably not less than 57. In light of spin suppression and feel at impact, the hardness Hb is preferably not greater than 85 and more preferably not greater than 83.

In light of spin suppression, the Shore C hardness Hs at the surface of the core 4 is preferably not less than 70, more preferably not less than 72, and particularly preferably not less than 74. In light of durability of the golf ball 2, the hardness Hs is preferably not greater than 90, more preferably not greater than 88, and particularly preferably not greater than 86.

The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 that includes the mid layer 6 including an ionomer resin has excellent flight performance upon a shot with a driver.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the mid layer 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferable. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably not less than 10% by weight, more preferably not less than 12% by weight, and particularly preferably not less than 15% by weight. In light of feel at impact upon a shot with a driver, the content is preferably not greater than 50% by weight, more preferably not greater than 47% by weight, and particularly preferably not greater than 45% by weight.

In the present invention, styrene block-containing thermoplastic elastomers include an alloy of an olefin and one or more members selected from the group consisting of SBS, SIS, SIBS, SEBS, SEPS, and SEEPS. The olefin component in the alloy is presumed to contribute to improvement of compatibility with another base polymer. The alloy can contribute to the resilience performance of the golf ball 2.

An olefin having 2 to 10 carbon atoms is preferable. Examples of suitable olefins include ethylene, propylene, butene, and pentene. Ethylene and propylene are particularly preferable.

Specific examples of polymer alloys include trade names "RABALON T3221C", "RABALON T3339C", "RABALON SJ4400N", "RABALON SJ5400N", "RABALON SJ6400N", "RABALON SJ7400N", "RABALON SJ8400N", "RABALON SJ9400N", and "RABALON SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "SEPTON HG-252" manufactured by Kuraray Co., Ltd.

In light of feel at impact upon a shot with a driver, the proportion of the styrene block-containing thermoplastic elastomer to the entire base polymer is preferably not less than 3% by weight and particularly preferably not less than 5% by weight. In light of spin suppression upon a shot with a driver, the proportion is preferably not greater than 50% by weight, more preferably not greater than 47% by weight, and particularly preferably not greater than 45% by weight.

As necessary, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of the mid layer 6 in an adequate amount.

For forming the mid layer 6, known methods such as injection molding, compression molding, and the like can be used.

As described above, when the mid layer 6 is composed of a single layer, the slab hardness of the mid layer 6 is regarded as Hm, and when the mid layer 6 is formed of a plurality of layers, the slab hardness of the most flexible layer among the plurality of layers is regarded as Hm. The slab hardness of the mid layer 6 or each layer forming the mid layer 6 is set as appropriate within a range where the hardness Hm satisfies the aforementioned formulas (2) and (3). In the present invention, the hardness Hm is not particularly limited, but is preferably greater than 40, more preferably not less than 42, and particularly preferably not less than 44, in light of spin suppression upon a shot with a driver. In light of feel at impact, the hardness Hm is preferably less than 67, more preferably less than 65, and particularly preferably not greater than 63.

In the golf ball according to the present invention, the positions of the point A and the point B within the core 4 are set in accordance with the total thickness L (mm) of the mid layer 6 and the cover 8, and the hardness Ha at the point A and the hardness Hb at the point B are adjusted so as to satisfy the aforementioned formulas (1) and (3). In this respect, a thickness Tm of the mid layer 6 is set as appropriate within a range where the formulas (1) and (3) are satisfied, in a relationship with a thickness Tc of the cover 8, the hardness Ha, and the hardness Hb. When the mid layer 6 is formed of a plurality of layers, the sum of the thicknesses of the respective layers is regarded as the thickness Tm. From the standpoint that adjustment of the formulas (1) and (3) is easy, the thickness Tm is preferably not less than 0.5 mm and not greater than 2.5 mm. The thickness Tm is measured at a position immediately below the land 12.

The cover 8 is formed from a resin composition. A preferable base polymer of the resin composition is an ionomer resin. The golf ball 2 that includes the cover 8 including the ionomer resin has excellent resilience performance. The ionomer resins described above for the mid layer 6 can be used for the cover 8.

Instead of the ionomer resin or together with the ionomer resin, the resin composition of the cover 8 may include another polymer. Examples of the other polymer include polystyrenes, polyamides, polyesters, polyolefins, and polyurethanes. The resin composition may include two or more polymers.

The resin composition of the cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

In the present invention, the hardness Hc of the cover 8 is not particularly limited, and is set as appropriate within a range where the aforementioned formula (1) is satisfied. Preferably, the cover 8 is harder than the mid layer 6. When the mid layer 6 is formed of a plurality of layers, the cover 8 is preferably harder than the hardest layer among the plurality of layers. Because of the cover 8, an outer-hard/inner-soft structure can be formed in the golf ball 2. The golf ball 2 has excellent flight performance and feel at impact.

In light of spin suppression upon a shot with a driver, the hardness Hc is preferably not less than 76, more preferably not less than 77, and particularly preferably not less than 78. In light of feel at impact upon putting, the hardness Hc is preferably not greater than 97, more preferably not greater than 96, and particularly preferably not greater than 95.

In light of feel at impact upon putting, the thickness Tc of the cover 8 is preferably not greater than 2.0 mm, more preferably not greater than 1.9 mm, and particularly preferably not greater than 1.8 mm. In light of durability and ease of production, the thickness Tc is preferably not less than 0.8 mm, more preferably not less than 0.9 mm, and particularly preferably not less than 1.0 mm. The thickness Tc is set as appropriate within a range where the formulas (1) and (3) are satisfied, in a relationship with the thickness Tm of the mid layer 6, the hardness Ha, and the hardness Hb. The thickness Tc is measured at a position immediately below the land 12.

In light of feel at impact upon putting, the total thickness L of the mid layer 6 and the cover 8 is preferably not greater than 3.2 mm, more preferably not greater than 3.0 mm, and particularly preferably not greater than 2.8 mm. In light of durability and ease of production, the total thickness L is preferably not less than 1.0 mm.

For forming the cover 8, known methods such as injection molding, compression molding, and the like can be used. When forming the cover 8, the dimples 10 are formed by pimples formed on the cavity face of a mold.

In light of feel at impact, the golf ball 2 has an amount of compressive deformation Sf of preferably not less than 2.5 mm, more preferably not less than 2.7 mm, and particularly preferably not less than 2.8 mm. In light of resilience performance, the amount of compressive deformation Sf is preferably not greater than 4.5 mm, more preferably not greater than 4.3 mm, and particularly preferably not greater than 4.2 mm.

In measurement of the amount of compressive deformation, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured.

EXAMPLES

The following will show the effects of the present invention by means of Examples, but the present invention should not be construed in a limited manner based on the description of these Examples.

Example 1

A rubber composition was obtained by kneading 100 parts by weight of a high-cis polybutadiene (trade name "BR-730", manufactured by JSR Corporation), 25.0 parts by weight of zinc diacrylate, 12 parts by weight of zinc oxide, an appropriate amount of barium sulfate, 0.9 parts by weight of dicumyl peroxide, 0.5 parts by weight of diphenyl disulfide, 0.1 parts by weight of 2-thionaphthol, and 2 parts by weight of benzoic acid. This rubber composition was placed into a mold including upper and lower mold halves each having a hemispherical cavity, and heated at 160° C. for 20 minutes to obtain a core having a diameter of 38.6 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "RABALON T3221C", manufactured by Mitsubishi Chemical Corporation), 3 parts by weight of titanium dioxide, and 0.2 parts by weight a light stabilizer (trade name "JF-90", manufactured by Johoku Chemical Co., Ltd.) with a twin-screw kneading extruder. As the extruding conditions, a screw diameter was set to 45 mm, a rotational speed was set to 200 rpm, screw L/D was set to 35, and a measurement temperature at the position of a die was set to 160° C. to 240° C. The core was covered with the obtained resin composition by injection molding to form a mid layer having a thickness of 1.00 mm.

A resin composition was obtained by kneading 55 parts by weight of an ionomer resin (trade name "Himilan AM7329", manufactured by Du Pont-MITSUI POLYCHEMICALS Co., Ltd.), 45 parts by weight of another ionomer resin (trade name "Himilan 1555", manufactured by Du Pont-MITSUI POLYCHEMICALS Co., Ltd.), 3 parts by weight of titanium dioxide, and 0.2 parts by weight of a light stabilizer (the aforementioned "JF-90") with a twin-screw kneading extruder. The sphere consisting of the core and the mid layer was placed into a final mold that includes upper and lower mold halves each having a hemispherical cavity and having a large number of pimples on its cavity face. The mid layer was covered with the resin composition by injection molding to form a cover having a thickness of 1.05 mm. Dimples having a shape that is the inverted shape of the pimples were formed on the cover. A clear paint including a two-component curing type polyurethane as a base material was applied to this cover to obtain a golf ball of Example 1 having a diameter of about 42.7 mm and a weight of about 45.6 g. The hardness H0, the hardness Ha, the hardness Hb, the hardness Hs, the hardness Hm, and the hardness Hc measured for this golf ball, and the hardness differences therebetween are shown in Tables 5 and 9.

Examples 2 to 9 and 12 and Comparative Examples 1 to 5

Golf balls of Examples 2 to 9 and 12 and Comparative Examples 1 to 5 were obtained in the same manner as Example 1, except the specifications of the core, the mid layer, and the cover were as shown in Tables 5 to 8 below. The rubber composition of the core is shown in detail in Tables 1 and 2 below. The resin compositions of the mid layer and the cover are shown in detail in Tables 3 and 4 below. The hardness H0, the hardness Ha, the hardness Hb, the hardness Hs, the hardness Hm, and the hardness Hc measured for each of the golf balls of Examples 2 to 9 and 12 and Comparative Examples 1 to 5, and the hardness differences therebetween are shown in Tables 5 to 12.

Example 10

A rubber composition was obtained by kneading 100 parts by weight of a high-cis polybutadiene (the aforementioned "BR-730"), 24.0 parts by weight of zinc diacrylate, 12 parts by weight of zinc oxide, an appropriate amount of barium sulfate, 0.9 parts by weight of dicumyl peroxide, 0.5 parts by weight of diphenyl disulfide, 0.1 parts by weight of 2-thionaphthol, and 2 parts by weight of benzoic acid. This rubber composition was placed into a mold including upper and lower mold halves each having a hemispherical cavity, and heated at 160° C. for 20 minutes to obtain a core having a diameter of 36.6 mm. The amount of barium sulfate was adjusted such that a core having a predetermined weight was obtained.

A resin composition was obtained by kneading 22 parts by weight of an ionomer resin (the aforementioned "Himilan AM7337"), 22 parts by weight of another ionomer resin (the aforementioned "Himilan AM7329"), 56 parts by weight a styrene block-containing thermoplastic elastomer (the aforementioned "RABALON T3221C"), 3 parts by weight of titanium dioxide, and 0.2 parts by weight of a light stabilizer (the aforementioned "JF-90") with a twin-screw kneading extruder under the same extruding conditions as those in Example 1. The core was covered with the obtained resin composition by injection molding to form a mid layer (first layer) having a thickness of 1.00 mm.

Subsequently, a resin composition was obtained by kneading 30.5 parts by weight of an ionomer resin (the aforementioned "Himilan AM7337"), 30.5 parts by weight of another ionomer resin (the aforementioned "Himilan AM7329"), 39 parts by weight a styrene block-containing thermoplastic elastomer (the aforementioned "RABALON T3221C"), 3 parts by weight of titanium dioxide, and 0.2 parts by weight of a light stabilizer (the aforementioned "JF-90") with a twin-screw kneading extruder under the same extruding conditions as those in Example 1. The sphere consisting of the core and the mid layer (first layer) was covered with this resin composition by injection molding to form a mid layer (second layer) having a thickness of 1.00 mm.

A resin composition was obtained by kneading 55 parts by weight of an ionomer resin (the aforementioned "Himilan AM7329"), 45 parts by weight of another ionomer resin (the aforementioned "Himilan 1555"), 3 parts by weight of titanium dioxide, and 0.2 parts by weight of a light stabilizer (the aforementioned "JF-90") with a twin-screw kneading extruder. The sphere consisting of the core, the mid layer (first layer), and the mid layer (second layer) was placed into a final mold that includes upper and lower mold halves each having a hemispherical cavity and having a large number of pimples on its cavity face. The sphere was covered with the resin composition by injection molding to form a cover having a thickness of 1.05 mm. Dimples having a shape that is the inverted shape of the pimples were formed on the cover. A clear paint including a two-component curing type polyurethane as a base material was applied to this cover to obtain a golf ball of Example 10 having a diameter of about 42.7 mm and a weight of about 45.6 g. The hardness H0, the hardness Ha, the hardness Hb, the hardness Hs, the hardness Hm, and the hardness Hc measured for the golf ball of Example 10, and the hardness differences therebetween are shown in Tables 8 and 12. The hardness Hm in the golf ball of Example 10 is a slab hardness of the mid layer (first layer).

Example 11 and Comparative Examples 6 and 7

Golf balls of Example 11 and Comparative Examples 6 and 7 were obtained in the same manner as Example 10, except the specifications of the core, the mid layer (first layer), the mid layer (second layer), and the cover were as shown in Table 8 below. The rubber composition of the core is shown in detail in Tables 1 and 2 below. The resin compositions of the mid layer (first layer), the mid layer (second layer), and the cover are shown in detail in Tables 3 and 4 below. The hardness H0, the hardness Ha, the hardness Hb, the hardness Hs, the hardness Hm, and the hardness Hc measured for each of the golf balls of Example 11 and Comparative Examples 6 and 7, and the hardness differences therebetween are shown in Tables 8 and 12. The hardness Hm in the golf ball of Example 11 is a slab hardness of the mid layer (second layer). The hardness Hm in each of the golf balls of Comparative Examples 6 and 7 is a slab hardness of the mid layer (first layer).

[Amount of Compressive Deformation]

An amount of deformation (an amount by which a golf ball contracted) Sf in a compression direction from a state where an initial load of 98 N was applied to the golf ball until a final load of 1274 N was applied to the golf ball, was measured. The obtained amount of deformation Sf is shown in Tables 9 to 12.

[Shot with Driver (W#1)]

A driver (trade name "XXIO9", manufactured by DUNLOP SPORTS CO. LTD., shaft hardness: R, loft angle: 10.5°) was attached to a swing machine manufactured by Golf Laboratories, Inc. A golf ball was hit under a condition of a head speed of 40 m/sec. The ball speed (m/s) and the spin rate (rpm) immediately after the hit and the flight distance (m) from the launch point to the stop point were measured. The average value of data obtained by 12 measurements is shown in Tables 9 to 12 below.

TABLE 1

Composition of Core (parts by weight)

| Type | A | B | C | D |
|---|---|---|---|---|
| Polybutadiene | 100 | 100 | 100 | 100 |
| Zinc diacrylate | 25.0 | 22.0 | 28.0 | 24.0 |
| Zinc oxide | 12 | 12 | 12 | 12 |
| Barium sulfate | * | * | * | * |
| Dicumyl peroxide | 0.9 | 0.9 | 0.9 | 0.9 |
| Diphenyl disulfide | 0.5 | 0.5 | 0.5 | 0.5 |
| 2-thionaphthol | 0.1 | 0.1 | 0.1 | 0.1 |
| Benzoic acid | 2 | 2 | 2 | 2 |
| Vulcanization temp. (° C.) | 160 | 160 | 160 | 160 |
| Vulcanization time (min) | 20 | 20 | 20 | 20 |

* Appropriate amount

TABLE 2

Composition of Core (parts by weight)

| Type | E | F | G | H |
|---|---|---|---|---|
| Polybutadiene | 100 | 100 | 100 | 100 |
| Zinc diacrylate | 23.5 | 25.5 | 26.5 | 25.5 |
| Zinc oxide | 12 | 5 | 12 | 12 |
| Barium sulfate | * | * | * | * |
| Dicumyl peroxide | 0.9 | 0.9 | 0.9 | 0.9 |
| Diphenyl disulfide | 0.5 | 0.5 | 0.5 | 0.5 |
| 2-thionaphthol | 0.1 | — | 0.1 | 0.1 |
| Benzoic acid | 2 | — | 2 | 2 |
| Vulcanization temp. (° C.) | 160 | 170 | 160 | 160 |
| Vulcanization time (min) | 20 | 20 | 20 | 20 |

* Appropriate amount

The details of the compounds described in Tables 1 and 2 are as follows.

Polybutadiene: trade name "BR730" manufactured by JSR Corporation, a high-cis polybutadiene (cis-1,4-bond content: 96% by weight, 1,2-vinyl bond content: 1.3% by weight, Mooney viscosity ($ML_{1,4}$(100° C.)): 55, molecular weight distribution (Mw/Mn): 3).

Zinc diacrylate: trade name "Sanceler SR", manufactured by SANSHIN CHEMICAL INDUSTRY CO., LTD. (a product coated with 10% by weight of stearic acid).

Zinc oxide: trade name "Ginrei R", manufactured by Toho Zinc Co., Ltd.

Barium sulfate: trade name "Barium Sulfate BD", manufactured by Sakai Chemical Industry Co., Ltd.

Dicumyl peroxide: trade name "Percumyl D", manufactured by NOF Corporation.

Diphenyl disulfide: bis(pentabromophenyl)disulfide, manufactured by Kawaguchi Chemical Industry Co., Ltd.

2-thionaphthol: a product of Tokyo Chemical Industry Co., Ltd.

Benzoic acid: a product of Wako Pure Chemical Industries, Ltd.

TABLE 3

Compositions of Mid Layer and Cover (parts by weight)

| Type | a | b | c | d |
|---|---|---|---|---|
| Himilan AM7337 | 26 | 22 | 43 | 19.5 |
| Himilan AM7329 | 26 | 22 | 43 | 19.5 |
| Himilan 1555 | — | — | — | — |
| RABALON T3221C | 48 | 56 | 14 | 61 |
| Titanium dioxide | 3 | 3 | 3 | 3 |
| JF-90 | 0.2 | 0.2 | 0.2 | 0.2 |
| Slab hardness (Shore C) | 57 | 50 | 83 | 46 |

TABLE 4

Compositions of Mid Layer and Cover (parts by weight)

| Type | e | f | g | h |
|---|---|---|---|---|
| Himilan AM7337 | — | 30.5 | 38.5 | — |
| Himilan AM7329 | 55 | 30.5 | 38.5 | 61 |
| Himilan 1555 | 45 | — | — | 37 |
| RABALON T3221C | — | 39 | 23 | 2 |
| Titanium dioxide | 3 | 3 | 3 | 3 |
| JF-90 | 0.2 | 0.2 | 0.2 | 0.2 |
| Slab hardness (Shore C) | 92 | 63 | 76 | 89 |

TABLE 5

| Specifications of Golf Ball | Ex. 1 | Ex. 2 | Ex. 3 | Ex. 4 | Ex. 5 |
|---|---|---|---|---|---|
| Core | | | | | |
| Composition | A | B | C | G | D |
| Diameter (mm) | 38.6 | 38.6 | 38.6 | 39.4 | 38.2 |
| Mid layer | | | | | |
| Composition | a | a | a | a | a |
| Tm (mm) | 1.00 | 1.00 | 1.00 | 0.85 | 1.00 |
| Cover | | | | | |
| Composition | e | e | e | e | e |
| Tc (mm) | 1.05 | 1.05 | 1.05 | 0.80 | 1.25 |
| Total thickness L (mm) | 2.05 | 2.05 | 2.05 | 1.65 | 2.25 |
| Ho (Shore C) | 48 | 46 | 50 | 49 | 47 |
| Ha (Shore C) | 60 | 58 | 62 | 65 | 58 |
| Hb (Shore C) | 72 | 70 | 74 | 76 | 69 |
| Hs (Shore C) | 78 | 76 | 80 | 79 | 77 |
| Hm (Shore C) | 57 | 57 | 57 | 57 | 57 |
| Hc (Shore C) | 92 | 92 | 92 | 92 | 92 |

TABLE 6

| Specifications of Golf Ball | Ex. 6 | Comp. Ex. 1 | Comp. Ex. 2 | Comp. Ex. 3 | Comp. Ex. 4 |
|---|---|---|---|---|---|
| Core | | | | | |
| Composition | E | F | D | H | A |
| Diameter (mm) | 37.5 | 38.6 | 38.6 | 38.6 | 38.6 |
| Mid layer | | | | | |
| Composition | a | a | c | d | e |
| Tm (mm) | 1.00 | 1.00 | 1.00 | 1.00 | 1.00 |
| Cover | | | | | |
| Composition | e | e | e | e | a |
| Tc (mm) | 1.60 | 1.05 | 1.05 | 1.05 | 1.05 |
| Total thickness L (mm) | 2.60 | 2.05 | 2.05 | 2.05 | 2.05 |
| Ho (Shore C) | 47 | 58 | 47 | 48 | 48 |
| Ha (Shore C) | 57 | 66 | 59 | 60 | 60 |
| Hb (Shore C) | 65 | 69 | 71 | 72 | 72 |
| Hs (Shore C) | 77 | 75 | 77 | 78 | 78 |
| Hm (Shore C) | 57 | 57 | 83 | 46 | 92 |
| Hc (Shore C) | 92 | 92 | 92 | 92 | 57 |

TABLE 7

| Specifications of Golf Ball | Comp. Ex. 5 | Ex. 7 | Ex. 8 | Ex. 9 |
|---|---|---|---|---|
| Core | | | | |
| Composition | A | A | A | F |
| Diameter (mm) | 38.6 | 38.2 | 38.6 | 38.6 |
| Mid layer | | | | |
| Composition | a | a | a | f |
| Tm (mm) | 1.00 | 1.00 | 1.00 | 1.00 |
| Cover | | | | |
| Composition | f | e | h | e |
| Tc (mm) | 1.05 | 1.25 | 1.05 | 1.05 |
| Total thickness L (mm) | 2.05 | 2.25 | 2.05 | 2.05 |
| Ho (Shore C) | 48 | 48 | 48 | 58 |

TABLE 7-continued

| Specifications of Golf Ball | Comp. Ex. 5 | Ex. 7 | Ex. 8 | Ex. 9 |
|---|---|---|---|---|
| Ha (Shore C) | 60 | 59 | 60 | 66 |
| Hb (Shore C) | 72 | 70 | 72 | 69 |
| Hs (Shore C) | 78 | 78 | 78 | 75 |
| Hm (Shore C) | 57 | 57 | 57 | 63 |
| Hc (Shore C) | 63 | 92 | 89 | 92 |

TABLE 8

| Specifications of Golf Ball | Ex. 10 | Ex. 11 | Ex. 12 | Comp. Ex. 6 | Comp. Ex. 7 |
|---|---|---|---|---|---|
| Core | | | | | |
| Composition | D | D | E | E | B |
| Diameter (mm) | 36.6 | 36.6 | 36.6 | 36.6 | 36.2 |
| Mid layer (first layer) | | | | | |
| Composition | b | f | b | a | a |
| Tm1 (mm) | 1.00 | 1.00 | 2.00 | 1.00 | 1.00 |
| Mid layer (second layer) | | | | | |
| Composition | f | b | — | f | g |
| Tm2 (mm) | 1.00 | 1.00 | — | 1.00 | 1.00 |
| Cover | | | | | |
| Composition | e | e | e | e | e |
| Tc (mm) | 1.05 | 1.05 | 1.05 | 1.05 | 1.25 |
| Total thickness L (mm) | 3.05 | 3.05 | 3.05 | 3.05 | 3.25 |
| Ho (Shore C) | 47 | 47 | 47 | 47 | 46 |
| Ha (Shore C) | 53 | 53 | 53 | 53 | 50 |
| Hb (Shore C) | 61 | 61 | 61 | 59 | 58 |
| Hs (Shore C) | 76 | 76 | 76 | 76 | 75 |
| Hm (Shore C) | 50 | 50 | 50 | 57 | 57 |
| Hc (Shore C) | 92 | 92 | 92 | 92 | 92 |

TABLE 9

| Results of Evaluation | Ex. 1 | Ex. 2 | Ex. 3 | Ex. 4 | Ex. 5 |
|---|---|---|---|---|---|
| Difference (Shore C) | | | | | |
| Hc-Hb | 20 | 22 | 18 | 16 | 23 |
| Hm-H0 | 9 | 11 | 7 | 8 | 10 |
| Ha-Hm | 3 | 1 | 5 | 8 | 1 |
| Hc-Hm | 35 | 35 | 35 | 35 | 35 |
| Hb-Hm | 15 | 13 | 17 | 19 | 12 |
| Hb-Ha | 12 | 12 | 12 | 10 | 11 |
| Ha-H0 | 12 | 12 | 12 | 16 | 11 |
| Hb-H0 | 24 | 24 | 24 | 27 | 22 |
| Hs-H0 | 30 | 30 | 30 | 30 | 30 |
| Sf (mm) | 3.66 | 3.96 | 3.37 | 3.66 | 3.66 |
| W#1 | | | | | |
| Ball speed (m/s) | 57.70 | 58.00 | 58.00 | 57.72 | 57.75 |
| Spin rate (rpm) | 2500 | 2400 | 2700 | 2500 | 2480 |
| Distance (m) | 199.3 | 200.1 | 198.9 | 199.4 | 199.8 |
| Feel at impact | S | S | A | S | A |

TABLE 10

| Results of Evaluation | Ex. 6 | Comp. Ex. 1 | Comp. Ex. 2 | Comp. Ex. 3 | Comp. Ex. 4 |
|---|---|---|---|---|---|
| Difference (Shore C) | | | | | |
| Hc-Hb | 27 | 23 | 21 | 20 | −15 |
| Hm-H0 | 10 | −1 | 36 | −2 | 44 |
| Ha-Hm | 0 | 9 | −24 | 14 | −32 |
| Hc-Hm | 35 | 35 | 9 | 46 | −35 |
| Hb-Hm | 8 | 13 | −12 | 26 | −20 |
| Hb-Ha | 8 | 4 | 12 | 12 | 12 |
| Ha-H0 | 10 | 8 | 12 | 12 | 12 |
| Hb-H0 | 18 | 11 | 24 | 24 | 24 |
| Hs-H0 | 30 | 17 | 30 | 30 | 30 |
| Sf (mm) | 3.66 | 3.66 | 3.66 | 3.66 | 3.66 |
| W#1 | | | | | |
| Ball speed (m/s) | 57.80 | 57.86 | 57.80 | 57.60 | 57.50 |
| Spin rate (rpm) | 2470 | 2700 | 2550 | 2650 | 2800 |
| Distance (m) | 200.1 | 198.2 | 199.3 | 197.5 | 195.7 |
| Feel at impact | A | S | C | S | B |

TABLE 11

| Results of Evaluation | Comp. Ex. 5 | Ex. 7 | Ex. 8 | Ex. 9 |
|---|---|---|---|---|
| Difference (Shore C) | | | | |
| Hc-Hb | −9 | 22 | 17 | 23 |
| Hm-H0 | 9 | 9 | 9 | 5 |
| Ha-Hm | 3 | 2 | 3 | 3 |
| Hc-Hm | 6 | 35 | 32 | 29 |
| Hb-Hm | 15 | 13 | 15 | 6 |
| Hb-Ha | 12 | 11 | 12 | 3 |
| Ha-H0 | 12 | 11 | 12 | 8 |
| Hb-H0 | 24 | 22 | 24 | 11 |
| Hs-H0 | 30 | 30 | 30 | 17 |
| Sf (mm) | 3.96 | 3.57 | 3.69 | 3.57 |
| W#1 | | | | |
| Ball speed (m/s) | 57.55 | 57.80 | 57.67 | 57.75 |
| Spin rate (rpm) | 2700 | 2510 | 2550 | 2540 |
| Distance (m) | 196.8 | 199.7 | 198.8 | 199.2 |
| Feel at impact | S | A | S | A |

TABLE 12

| Results of Evaluation | Ex. 10 | Ex. 11 | Ex. 12 | Comp. Ex. 6 | Comp. Ex. 7 |
|---|---|---|---|---|---|
| Difference (Shore C) | | | | | |
| Hc-Hb | 31 | 31 | 31 | 33 | 34 |
| Hm-H0 | 3 | 3 | 3 | 10 | 11 |
| Ha-Hm | 3 | 3 | 3 | −4 | −7 |
| Hc-Hm | 42 | 42 | 42 | 35 | 35 |
| Hb-Hm | 11 | 11 | 11 | 2 | 1 |
| Hb-Ha | 8 | 8 | 8 | 6 | 8 |
| Ha-H0 | 6 | 6 | 6 | 6 | 4 |
| Hb-H0 | 14 | 14 | 14 | 12 | 12 |
| Hs-H0 | 29 | 29 | 29 | 29 | 29 |
| Sf (mm) | 3.66 | 3.66 | 3.66 | 3.66 | 3.66 |

TABLE 12-continued

| Results of Evaluation | Ex. 10 | Ex. 11 | Ex. 12 | Comp. Ex. 6 | Comp. Ex. 7 |
|---|---|---|---|---|---|
| W#1 | | | | | |
| Ball speed (m/s) | 57.68 | 57.67 | 57.60 | 57.69 | 57.45 |
| Spin rate (rpm) | 2500 | 2505 | 2530 | 2500 | 2500 |
| Distance (m) | 199.2 | 217.8 | 217.2 | 199.3 | 198.2 |
| Feel at impact | A | A | A | C | C |

As shown in Tables 9 to 12, the golf ball of each Example is excellent in flight performance when being hit with a driver and feel at impact upon putting. From the results of evaluation, advantages of the present invention are clear.

The golf ball according to the present invention can be used for playing golf on golf courses and practicing at driving ranges. The above descriptions are merely illustrative examples, and various modifications can be made without departing from the principles of the present invention.

What is claimed is:

1. A golf ball comprising a core, a mid layer positioned outside the core, and a cover positioned outside the mid layer, wherein when a total thickness of the mid layer and the cover is denoted by L (mm), a Shore C hardness at a point A away from a surface of the core toward a central point of the core by 5L (mm) is denoted by Ha, a Shore C hardness at a point B away from the surface of the core toward the central point of the core by 2.5L (mm) is denoted by Hb, a Shore C hardness at the central point of the core is denoted by H0, a Shore C hardness of the mid layer is denoted by Hm, and a Shore C hardness of the cover is denoted by Hc, the golf ball satisfies the following formulas (1) to (3):

$$Hc-Hb \geq 17 \quad (1),$$

$$Hm-H0>0 \quad (2),$$

$$Ha-Hm>0 \quad (3),$$

an amount of compressive deformation Sf of the golf ball is not less than 3.66 mm, a difference (Hb−Ha) between the hardness Hb and the hardness Ha is not less than 10, and the hardness Hm is greater than 40 and not greater than 57.

2. The golf ball according to claim 1, wherein the mid layer is formed of a plurality of layers, and the hardness Hm is a Shore C hardness of a most flexible layer among the plurality of layers forming the mid layer.

3. The golf ball according to claim 1, wherein a difference (Hc−Hb) between the hardness Hc and the hardness Hb is not less 17 and less than 40.

4. The golf ball according to claim 1, wherein a difference (Hm−H0) between the hardness Hm and the hardness H0 is not less than 1 and not greater than 20.

5. The golf ball according to claim 1, wherein a difference (Ha−Hm) between the hardness Ha and the hardness Hm is not less than 1 and not greater than 15.

6. The golf ball according to claim 1, wherein a difference (Hs−H0) between a Shore C hardness Hs at the surface of the core and the hardness H0 is not less than 20 and not greater than 40.

7. The golf ball according to claim 1, wherein a difference (Hc−Hm) between the hardness Hc and the hardness Hm is greater than 25 and less than 50.

8. The golf ball according to claim 1, wherein a difference (Hb−Hm) between the hardness Hb and the hardness Hm is greater than 5 and less than 25.

9. The golf ball according to claim 1, wherein a difference (Hb−Ha) between the hardness Hb and the hardness Ha is not less than 10 and less than 15.

10. The golf ball according to claim 1, wherein a difference (Ha−H0) between the hardness Ha and the hardness H0 is greater than 5 and less than 18.

11. The golf ball according to claim 1, wherein a difference (Hb−H0) between the hardness Fib and the hardness H0 is greater than 12 and less than 30.

12. The golf ball according to claim 1, wherein the total thickness L is not greater than 3.2 mm.

13. The golf ball according to claim 1, wherein
the mid layer is formed of a plurality of layers, and
the hardness Hc is greater than a Shore C hardness of a hardest layer among the plurality of layers forming the mid layer.

14. The golf ball according to claim 1, wherein
the core has a diameter of not less than 36.0 mm and not greater than 41.0 mm.

15. The golf ball according to claim 1, wherein
the Shore C hardness Ha is not less than 45 and not greater than 78.

16. The golf ball according to claim 1, wherein
the Shore C hardness Hb is not less than 55 and not greater than 85.

17. The golf ball according to claim 1, wherein
the hardness Hc is not less than 76 and not greater than 97.

* * * * *